US005539155A

United States Patent [19]

Kunieda et al.

[11] Patent Number: 5,539,155

[45] Date of Patent: Jul. 23, 1996

[54] METAL FITTING FOR COMPOSITE INSULATORS

[75] Inventors: Shigehiko Kunieda, Iwakura; Takeshi Shogo, Kani, both of Japan

[73] Assignee: NGK Insulators, Ltd., Japan

[21] Appl. No.: 216,885

[22] Filed: Mar. 24, 1994

[30] Foreign Application Priority Data

Mar. 25, 1993 [JP] Japan ..... 5-066670

[51] Int. Cl.[6] ..... H01B 17/02; H01B 17/40

[52] U.S. Cl. ..... 174/188; 174/158 R; 174/179; 174/209

[58] Field of Search ..... 174/169, 176, 174/178, 179, 180, 181, 182, 74 R, 152 R, 158 R, 209, 141 R, 75 R, 192, 80, 188, 189, 193

[56] References Cited

U.S. PATENT DOCUMENTS

| | | | |
|---|---|---|---|
| 3,698,749 | 10/1972 | Yonkers | 403/197 |
| 4,107,455 | 8/1978 | Richards | 174/140 |
| 4,421,948 | 12/1983 | Willem | 174/158 R |
| 4,435,615 | 3/1984 | Kaczerginski et al. | 174/189 |
| 5,253,946 | 10/1993 | Watkins | 403/268 |

FOREIGN PATENT DOCUMENTS

| | | | |
|---|---|---|---|
| 2069424 | 9/1971 | France . | |
| 1921299 | 11/1970 | Germany . | |
| 155597 | 3/1922 | United Kingdom | 174/193 |

*Primary Examiner*—Leo P. Picard
*Assistant Examiner*—Paramita Ghosh
*Attorney, Agent, or Firm*—Parkhurst, Wendel & Burr

[57] ABSTRACT

A metal fitting for a composite electrical insulator (1) including a plastic rod (2), e.g., an FRP rod. The metal fitting (4) includes a radially inwardly deformable sleeve portion having a bore (5) into which an end portion of the rod (1) can be inserted for fixedly securing the metal fitting (4) to the rod (1). The bore (5) in the metal fitting (4) has an inner surface which is formed with fine protrusions (7). These protrusions (7) provide a satisfactory resistivity to the tensile force applied to the insulator (1), to thereby effectively prevent withdrawal of the rod (2) from the metal fitting (4) when it is in use.

7 Claims, 3 Drawing Sheets

METAL FITTING FOR COMPOSITE INSULATORS

BACKGROUND OF THE INVENTION

1. Field of the Invention

The present invention relates generally to a metal fitting for composite electrical insulators, and more particularly to a metal fitting which is to be fixedly secured to one end portion of a plastic rod of the insulator for firmly and stably clamping the rod.

2. Description of the Related Art

A composite electrical insulator is known, e.g., from U.S. Pat. No. 4,654,478, wherein one end portion of a fiber-reinforced plastic rod applied with an adhesive material is inserted into the bore in a sleeve portion of the metal fitting and the metal fitting is then fixedly secured to the plastic rod. Such a metal fitting serves to clamp the rod and thereby connect the insulator to an electric cable or the like. The metal fitting is usually subjected to caulking, i.e., compressed radially inwardly onto the plastic rod, so as to firmly clamp the rod. That is to say, by compressing the metal fitting radially inwardly with a suitable die, that region of the plastic rod situated opposite to the metal fitting is uniformly clamped to integrally connect the metal fitting with the plastic rod for preventing withdrawal of the plastic rod from the fitting even under a large tensile force.

The composite electrical insulator as known from U.S. Pat. No. 4,654,478 proved to be highly advantageous in that it is light in weight and has a sufficient mechanical strength. However, there may be instances in a normal use condition of the insulator, wherein the plastic rod comes to be withdrawn from the metal fitting. Such withdrawal may be caused by a gradually decreased clamping force originating from the initial caulking, and/or upon application of an excessive tensile force to the insulator. In this connection, an increase in the initial clamping force is limited, e.g., in view of the compressive strength characteristic of the plastic material. Therefore, it is highly desirable to effectively prevent the withdrawal of the plastic rod from the metal fitting for a prolonged period, without increasing the initial clamping force.

SUMMARY OF THE INVENTION

It is therefore an object of the present invention to provide an improved metal fitting for composite electrical insulators, which is adapted to provide a higher resistivity to the tensile force applied to the insulator thereby effectively preventing withdrawal of the plastic rod from the metal fitting when it is in use.

According to the present invention, there is provided a metal fitting for a composite electrical insulator including a rod comprised of a plastic material, wherein said metal fitting comprises a radially inwardly deformable sleeve portion having a bore into which an end portion of the rod can be inserted for fixedly securing the metal fitting to said rod, said bore having an inner surface which is formed with fine protrusions.

With the above-mentioned arrangement in accordance with the present invention, when the metal fitting is in use, the fine protrusions on the inner surface of the bore in the metal fitting serve to provide a higher resistivity to the tensile force applied to the insulator. This is because the protrusions are forcibly urged into the outer surface of the plastic rod when the sleeve portion of the metal fitting is radially inwardly deformed and fixedly secured to the rod, e.g., by caulking. Consequently, the metal fitting according to the present invention serves to effectively prevent withdrawal of the plastic rod from the metal fitting when it is in use.

Advantageously, the fine protrusions on the inner surface of the bore in the metal fitting are in the form of a continuous ridge with a substantially constant height, extending helically along the inner surface of the bore with a predetermined axial pitch which may be approximately 0.5 mm. Such a helical ridge can be efficiently formed by a relatively simple machining tool, hence with an improved manufacturing productivity and at a reduced cost.

For achieving a satisfactory resistivity of the insulator to the tensile force, the fine protrusions may have a maximum height ($R_{max}$) which is approximately within a range between 5 μm and 250 μm, preferably between 50 μm and 200 μm.

The metal fitting may be be fixedly secured to the rod of the insulator by caulking, with an adhesive material applied to at least one of the opposite surfaces of the bore in the metal fitting and the rod of the insulator.

BRIEF DESCRIPTION OF THE DRAWINGS

The present invention will be further explained in detail hereinafter with reference to the accompanying drawing, in which.

DESCRIPTION OF THE PREFERRED EMBODIMENTS

Figure 1:
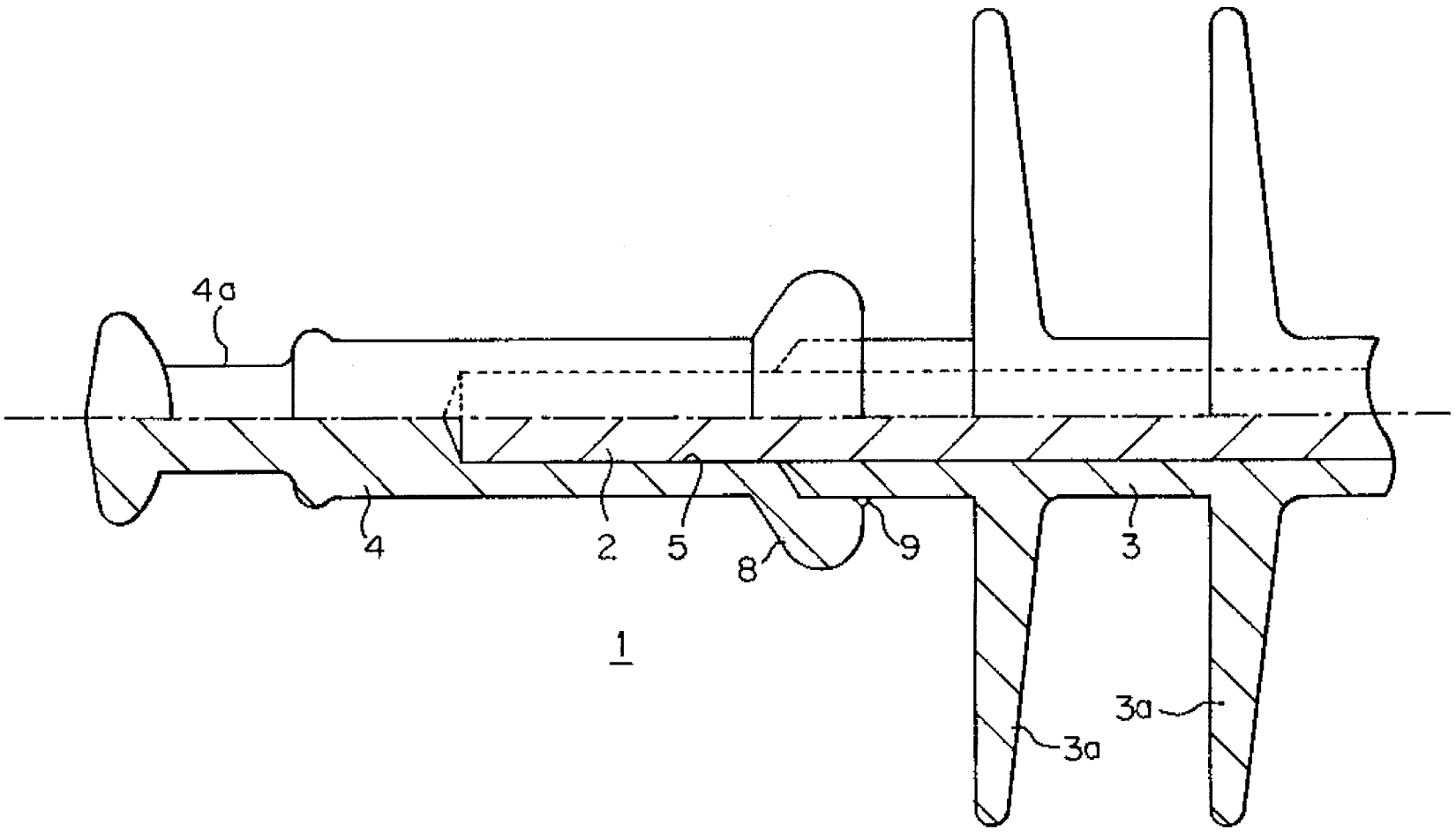
FIG. 1 is a fragmentary front view, partly in longitudinal section, of a composite electrical insulator incorporating a metal fitting according to the present invention.

Referring now to FIG. 1, there is shown a composite electrical insulator in the form of an FRP-type insulator, which is denoted as a whole by reference numeral 1, and to which the present invention may be applied. The insulator 1 includes a rod 2 comprised of a fiber-reinforced plastic material, which may be referred as "FRP rod" hereinafter. The FRP rod 2 is covered, either locally or entirely, by an insulating sheath 3 which is comprised of an appropriate resilient and electrically insulating material and provided with a series of shed portions 3*a*. These shed portions 3*a* are axially spaced from each other in a conventional manner, so as to preserve a desired surface leakage distance. There is shown in FIG. 1 a voltage application side of the insulator 1 where the FRP rod 2 is clamped by a metal fitting 4 according to the present invention. The insulator 1 has a ground side (not shown) which may also be clamped by a metal fitting with a similar clamp structure.

The fiber-reinforced plastic material forming the FRP rod 2 of the insulator 1 may comprise knitted or woven fibers or bundles of longitudinally oriented fibers, such as glass fibers or other appropriate fibers having a high modulus of elasticity, and a thermosetting type synthetic resin, such as epoxy resin, polyester resin or the like, impregnated in the fibers as a matrix resin. Thus, the FRP rod 2 has a high tensile strength and, hence, a high strength-to-weight ratio.

As explained above, the insulating sheath 3 is comprised of a resilient and electrically insulating material. Such material may be, e.g., silicone rubber, ethylenepropylene rubber or the like. The shape of the insulating sheath 3 and the region of the FRP rod 2 to be covered by the insulating sheath 3 may be designed in a conventional manner, in view of a proper avoidance of electrical contamination.

The metal fitting 4 according to the present invention may comprise a high tension steel, aluminum, ductile iron or other appropriate metal, which has been plated by zinc, for example. As shown in FIG. 1, the metal fitting 4 has a sleeve portion which is formed with a longitudinal bore 5 for receiving a corresponding axial end portion of the FRP rod 2. After the axial end portion of the FRP rod 2 has been inserted into the bore 5 in the metal fitting 4, a predetermined clamp region in the sleeve portion of the metal fitting 4, which extends over the end portion of the FRP rod 2, is subjected to caulking by an appropriate tool, not shown, so as to fixedly secure the metal fitting 4 to the FRP rod 2, while maintaining a required air tightness between the metal fitting 4 and the end region of the insulating sheath 3. The metal fitting 4 on its free end 4*a* remote from the rod 1 is adapted to be directly or indirectly connected to an electric cable, support arm of a tower and the like. To this end, the free end 4*a* of the metal fitting 4 may be formed as a bifurcated clevis or as a connection eye in a conventional manner.

Figure 2:
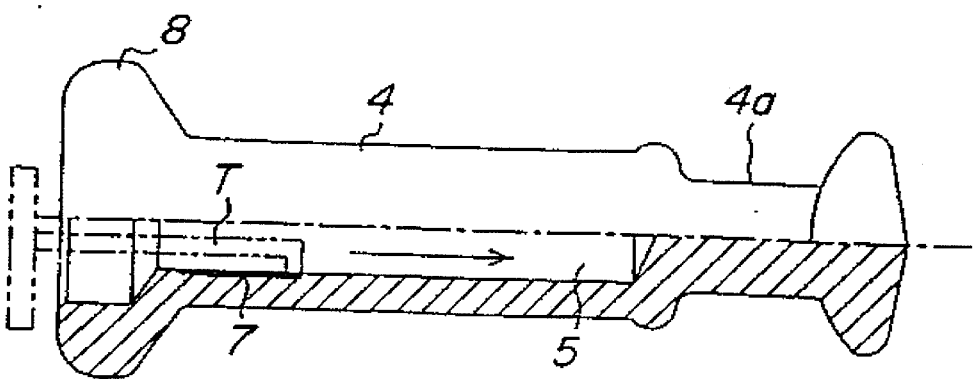
FIG. 2 is a front view, partly in longitudinal section, of a metal fitting according to one embodiment of the present invention.
Figure 3:
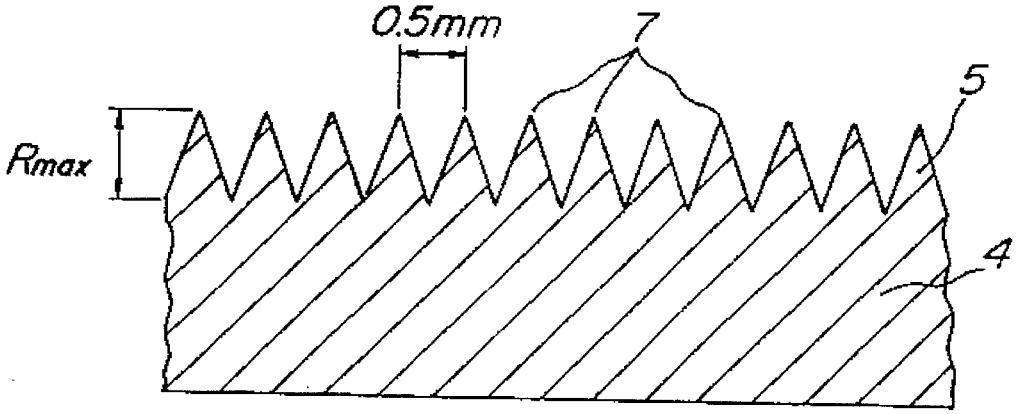
FIG. 3 is a fragmentary view in enlarged scale, showing one example of the fine protrusions on the inner surface of the bore in the metal fitting.

As further shown in FIG. 2, the bore 5 in the sleeve portion of the metal fitting 4 is formed by a cutting tool T which, in the illustrated embodiment, is capable of forming a female thread. Thus, by rotating the metal fitting 4 about its center axis and axially advancing the cutting tool T, a helical female thread 7 is formed substantially along the entire inner surface of the bore 5 with a predetermined pitch of 0.5 mm, for example, and the maximum height $R_{max}$ which may be approximately within a range between 5 μm and 250 μm, preferably between 50 μm and 200 μm, as will be discussed hereinafter.

The peaks of the female thread 7 on the inner surface of the bore 5 in the metal fitting 4 are continuous in the circumferential direction of the metal fitting 4, though they function as a series of discrete protrusions when observed in the axial direction of the metal fitting 4 in which the insulator is applied with a tensile force. These peaks are forcibly urged into the outer surface of the FRP rod 2 when the metal fitting 4 is radially inwardly deformed and fixedly secured to the FRP rod 2 by caulking.

The sleeve portion of the metal fitting 4 has an end region 8 opposite to the shed portions 3*a*, which is bulged radially outwardly providing a smoothly curved surface at the outer peripheral corners so as to avoid a flashover in the insulator. This end region 8 of the metal fitting 4 serves as a seal region for maintaining the above-mentioned air tightness between the metal fitting 4 and the opposite end region of the insulating sheath 3. In order to realize a further improved tightness between the insulating sheath 3 and the metal fitting 4, the gap between the end region of the insulating sheath 3 and the seal region 8 of the metal fitting 4 may be filled by appropriate sealant resin 9, such as silicone rubber.

Figure 4:
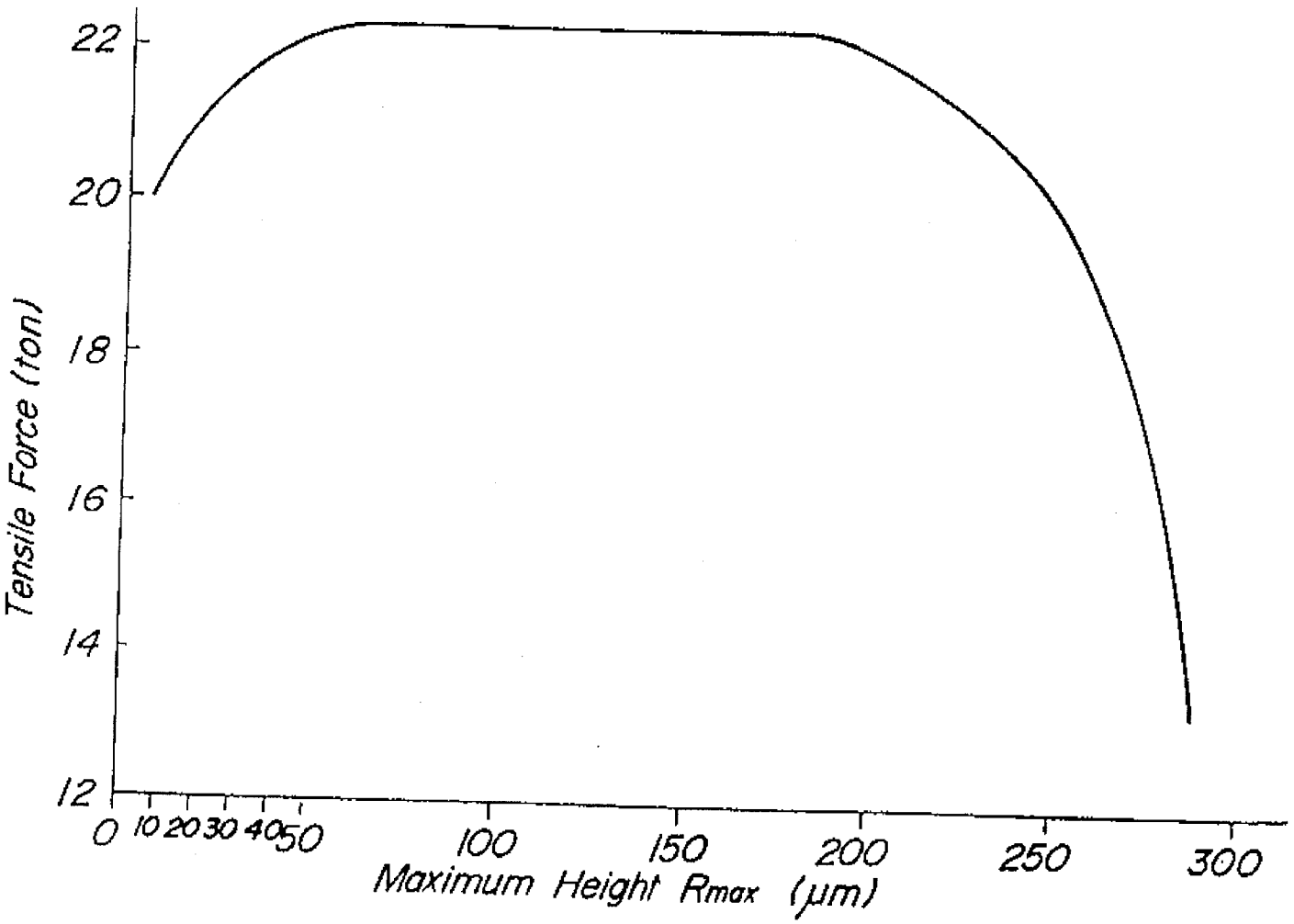
FIG. 4 is a graph showing the relationship between the tensile force and the maximum height of the fine protrusions.

The relationship between the tensile force and the maximum height $R_{max}$ of the female thread 4 in the metal fitting 4 will be explained below. FIG. 4 is a graph which shows the result of an experiment conducted to ascertain the above-mentioned relationship with reference to a set of samples. Each sample used for the experiment includes a combination of an FRP rod and a metal fitting according to the present invention. In this instance, each FRP rod has an outer diameter of 19 mm and is comprised of a plastic material which has been reinforced by glass fibers each having a diameter of 13 μm so that the glass content of the fiber reinforced plastic material is 75±1%. Furthermore, each metal fitting has a female thread on the inner surface of the bore, with an axial pitch of 0.5 mm and a different maximum height $R_{max}$. After the end portion of the FRP rod has been inserted into the bore of the metal fitting, the sleeve portion of the metal fitting was subjected to caulking by a die at three locations of the sleeve portion. The die has a width of 20 mm, and the clamping forces at the three locations were 260 kg/cm$^2$, 270 kg/cm$^2$ and 260 kg/cm$^2$, respectively. The total clamping width thus amounts to 60 mm.

It can be appreciated from FIG. 4 that the metal fitting according to the present invention provides a rupture strength of 20 tons of the clamp structure, by maintaining the maximum height $R_{max}$ of the female thread in the metal fitting substantially within a range between 5 μm and 250 μm, and is thus capable of withstanding a tensile force of no more than 20 tons which is applied to the insulator. It is therefore possible to prevent the withdrawal of the FRP rod from the metal fitting even when the insulator is applied with a tensile force of 20 tons or less.

Furthermore, an increase in the maximum height $R_{max}$ within a range between 5 μm and 50 μm results in a progressively increased rupture strength. Such increase in the rupture strength is considered due to an enhanced roughness of the inner surface of the bore in the metal fitting, with the pitch of the female thread maintained constant. That is to say, an enhanced surface roughness of the bore in combination with a constant pitch of the female thread results in that the angle of the peaks of the thread becomes more sharp and can thus be more positively urged into the outer surface of the FRP rod end region to provide an increased frictional force.

When the maximum height $R_{max}$ is substantially within a range between 50 μm and 200 μm, the rupture strength is maintained substantially constant with the peak value of approximately 22.2 tons. This is considered due to the fact that the stress prevailing in the clamped portions exceeds the absolute strength in the outer surface of the FRP rod 2. It is of course that the peak value of the rupture strength is dependent on the clamping width and the caulking force.

When the maximum height $R_{max}$ is more than 200 μm, the rupture strength exhibits a rapid decrease. This is because the angle of the peaks of the thread becomes excessively sharp so that the peaks tend to cut the glass fibers of the fiber reinforced plastic material in the outer surface region of the rod. Thus, an excessively enhanced surface roughness may require a correspondingly increased pitch of the female thread in order to maintain the angle of the peaks within a suitable range.

It will be appreciated from the foregoing description that the present invention provides an improved metal fitting for composite electrical insulators, which is adapted to provide a higher resistivity to the tensile force applied to the insulator thereby effectively preventing withdrawal of the fiber reinforced plastic rod from the metal fitting when it is in use.

While the present invention has been described with reference to certain preferred embodiments, they were given by way of examples only. Various changes and modifications may be made to the preferred embodiments without departing from the scope of the present invention as defined by the appended claims.

For example, the metal fitting according to the present invention may be applied to a composite insulator in which the rod comprises an electrically insulating resin other than fiber reinforced plastic material. Moreover, the protrusions on the inner surface of the bore in the metal fitting may be formed by a shot blasting process and may be different in height provided that they are sufficiently fine.

We claim:

1. A metal-to-plastic composite joint for a composite electrical insulator, comprising:

a rod member comprising a plastic material; and a metal fitting comprising a sleeve portion having a bore into which an end portion of said rod member is inserted, said sleeve portion being radially inwardly compressed to fixedly secure the end portion of said rod member in said bore, an inner surface of said bore having a plurality of fine protrusions which penetrate an outer surface of the end portion of said rod member.

2. The composite joint of claim 1, wherein substantially all of the fine protrusions formed in said bore are in direct contact with the outer surface of the end portion of said rod member.

3. The composite joint of claim 1, wherein said fine protrusions are in the form of a continuous ridge with a substantially constant height, said ridge extending helically along the inner surface of said bore with a predetermined axial pitch.

4. The composite joint of claim 3, wherein said pitch is approximately 0.5 mm.

5. The composite joint of claim 1, wherein said fine protrusions have a maximum height ($R_{max}$) of about 5 μm to 250 μm.

6. The composite joint of claim 5, wherein said maximum height ($R_{max}$) is about 50 μm to 200 μm.

7. The composite joint of claim 1, wherein said metal fitting is fixedly secured to the end portion of said rod by caulking.

* * * * *